US009074834B1

(12) United States Patent
Toto

(10) Patent No.: US 9,074,834 B1
(45) Date of Patent: Jul. 7, 2015

(54) TARGET SHOOTING GUN MUFFLER

(71) Applicant: Remo Toto, Lincoln University, PA (US)

(72) Inventor: Remo Toto, Lincoln University, PA (US)

( * ) Notice: Subject to any disclaimer, the term of this patent is extended or adjusted under 35 U.S.C. 154(b) by 0 days.

(21) Appl. No.: 14/591,982

(22) Filed: Jan. 8, 2015

(51) Int. Cl.
*F41A 35/00* (2006.01)
*F41A 21/30* (2006.01)

(52) U.S. Cl.
CPC ..... *F41A 35/00* (2013.01); *F41A 21/30* (2013.01)

(58) Field of Classification Search
CPC ..... F41J 11/02; F41A 35/00; F41A 21/30
USPC ..... 181/223; 89/14.4
See application file for complete search history.

(56) References Cited

U.S. PATENT DOCUMENTS 5,398,589 A * 3/1995 Kazyaka et al. ..... 89/14.4
5,686,688 A * 11/1997 Kazyaka et al. ..... 89/14.4
6,658,983 B2 * 12/2003 Kazyaka et al. ..... 89/14.4
6,826,995 B2 * 12/2004 Kazyaka et al. ..... 89/14.4

* cited by examiner

*Primary Examiner* — Jeremy Luks

(57) ABSTRACT

A gun muffler comprises an elongated housing which is lined with a sound absorbing foam. The front wall of the housing is transparent and has a centrally located entry hole for receiving a gun barrel. The back wall of the housing is transparent and has an exit hole. Cross hairs extend outwardly from each of the entry hole and exit hole.

19 Claims, 6 Drawing Sheets

TARGET SHOOTING GUN MUFFLER

BACKGROUND OF INVENTION

Gun mufflers are used in target shooting where it is desired to protect the hearing of the shooter and those around the shooter and in addition to adhere to noise ordinances of communities. Such gun mufflers take various forms. In general, the gun barrel would be inserted into the muffler and the noise of the shooter would be suppressed by the use of some sound absorbing material.

SUMMARY OF INVENTION

An object of this invention is to provide a gun muffler particularly useful for target shooting which not only suppresses the noise or sound but also facilitates the accuracy in the shooting of the gun.

A further object of this invention is to provide such a gun muffler which may be conveniently used and readily movable from one location to another.

In accordance with this invention the gun muffler comprises an elongated housing having an entry hole extending through its front wall and an exit hole extending through its back wall. The interior wall of the housing has a sound suppressing lining. Cross hairs are provided at both the entry hole and the exit hole so that, in use, the cross hairs may be aligned with each other and aligned with a target to facilitate shooting accuracy.

In a preferred embodiment of this invention both the front wall and the back wall are transparent to assure visibility in seeing and aligning the cross hairs. Preferably, the entry hole is oval in shape and is of larger size than the exit hole to permit gun barrel movement and accommodate different size gun barrels.

THE DRAWINGS

DETAILED DESCRIPTION

Figure 1:
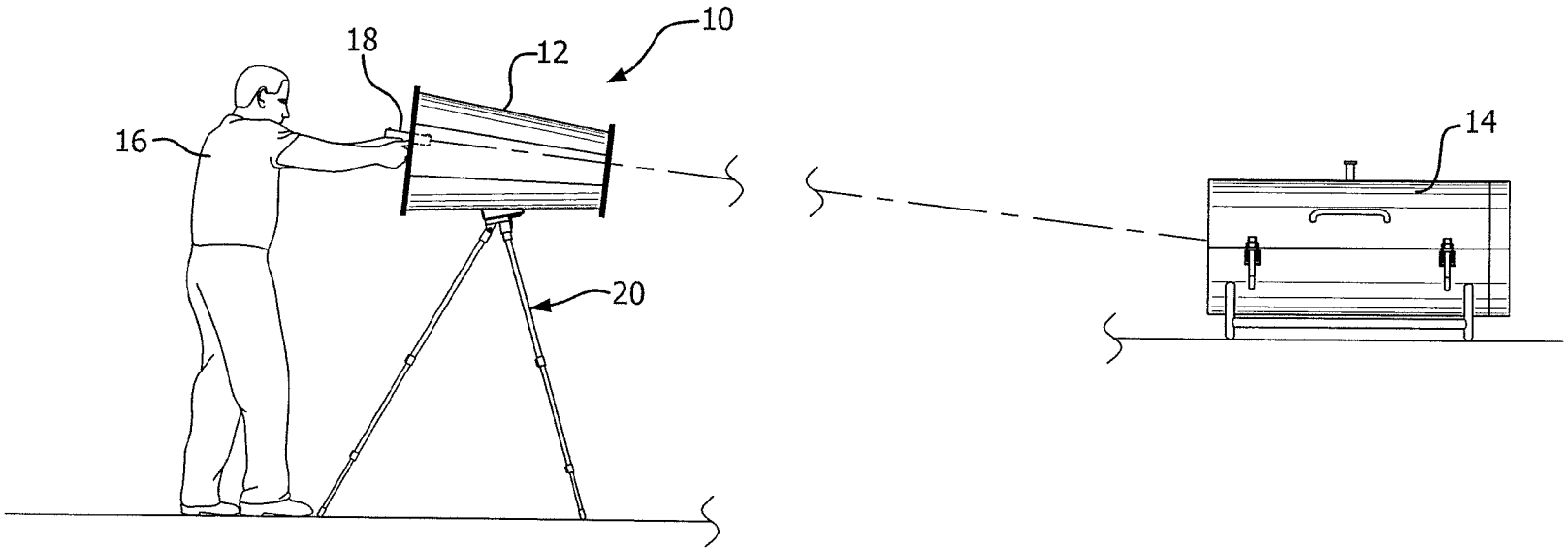
FIG. 1 is a side elevational view showing a gun muffler in accordance with this invention.

FIG. 1 shows a gun muffler 10 in accordance with this invention. As shown therein, gun muffler 10 includes a housing 12 located generally in line with a target 14. A shooter 16 would hold a gun 18 so that the barrel of the gun is inserted into the housing 12.

Figure 5:
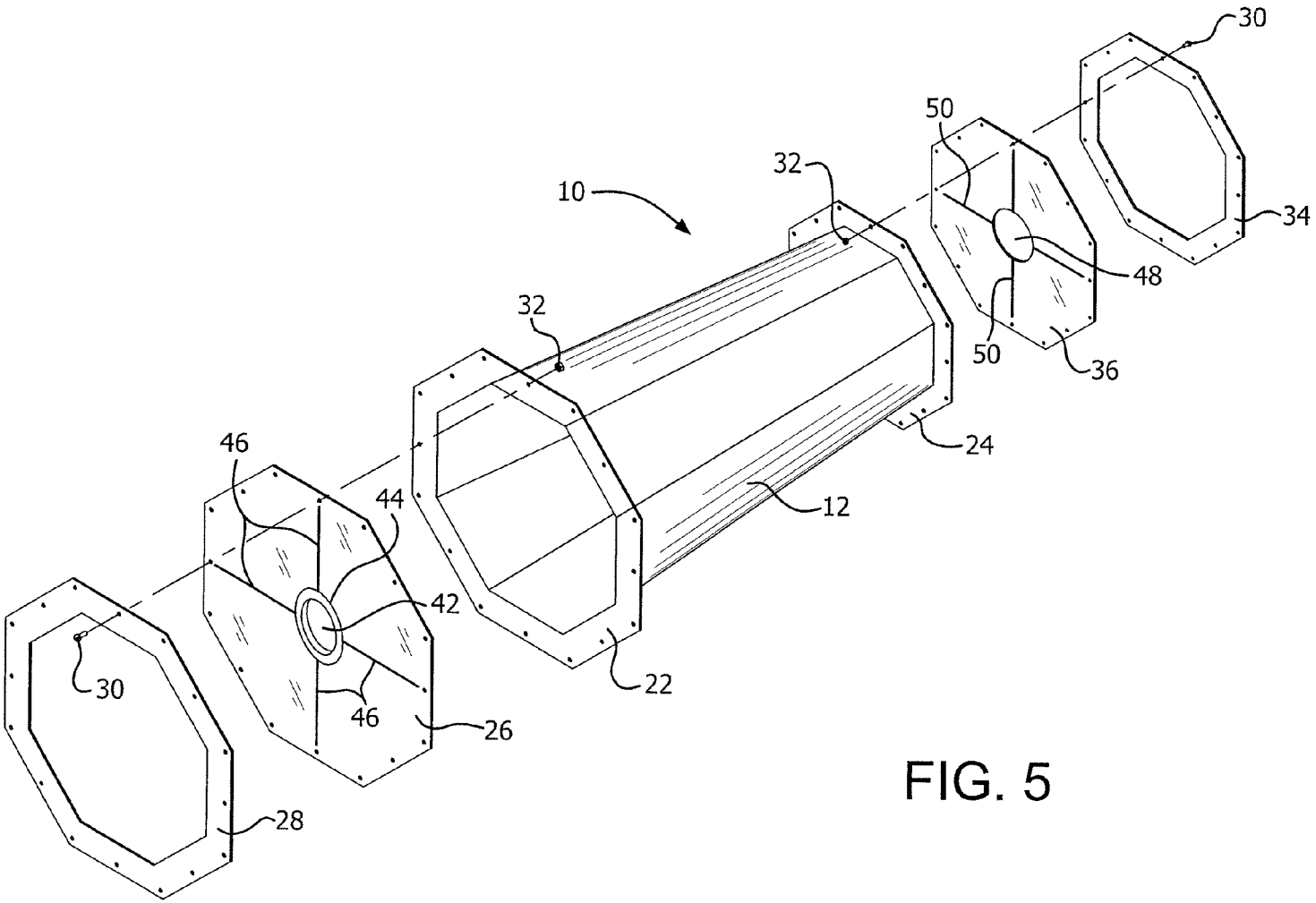
FIG. 5 is an exploded view of the gun muffler of FIGS. 1-4.

As shown in FIG. 5 housing 12 has a peripheral front rim 22 and a peripheral back rim 24. A front wall 26 is mounted against front rim 22 sandwiched between the front rim 22 and a frame 28. Front wall 26 is held in place by any suitable fasteners 30 extending through frame 28, front wall 26 and rim 22. For example, fastener 30 may be a screw which is held in place by nut 32. Similarly, a frame 34 mounts back wall 36 against rim 24 through the use of fasteners 30 and nuts 32.

Figure 6:
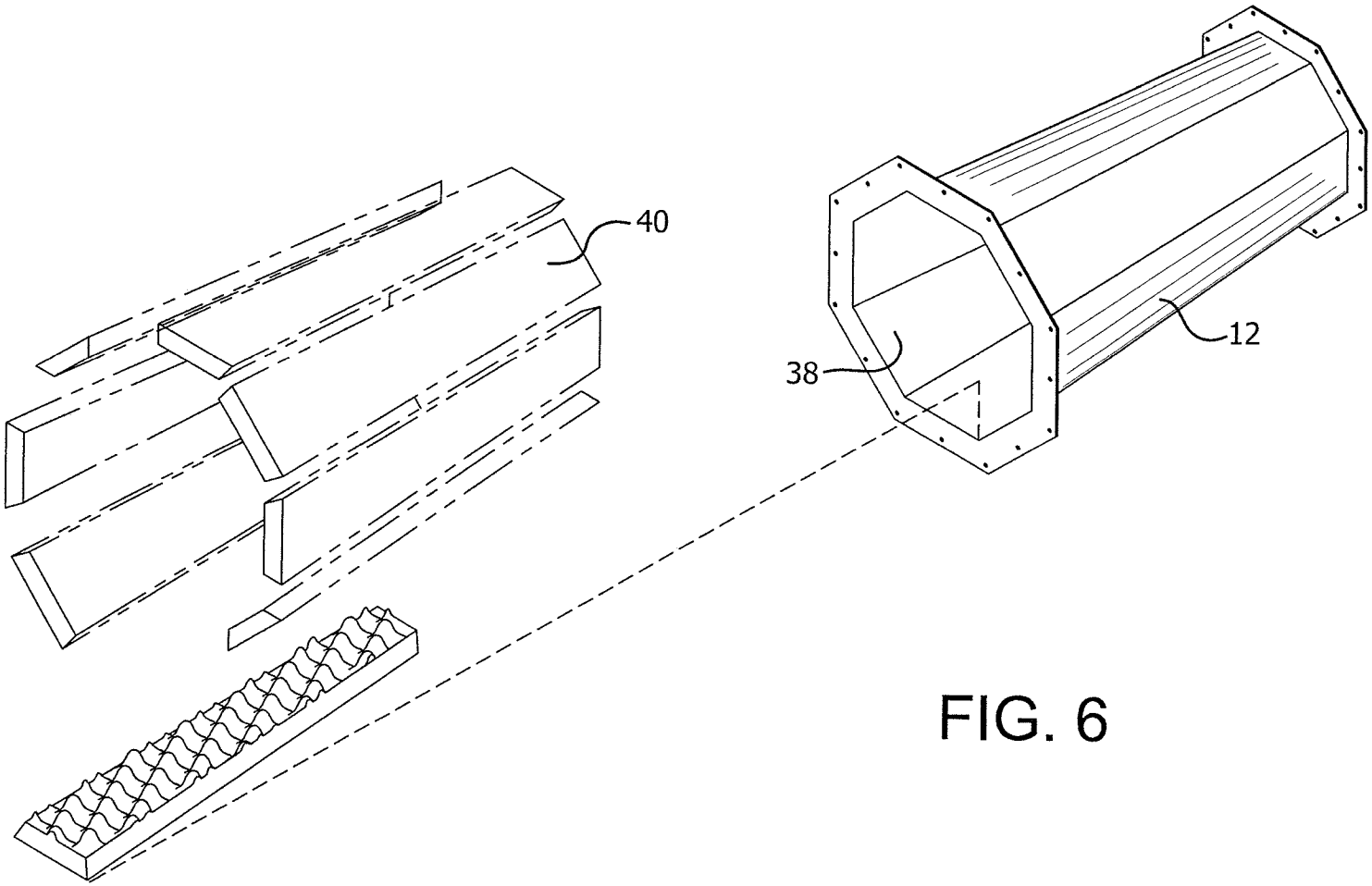
FIG. 6 is an exploded view of the portion of the gun muffler of FIGS. 1-5.

As shown in FIG. 6 housing 12 has an inner wall 38. In the illustrated embodiment housing 12 is of generally conical shape and more specifically is illustrated as having a tapered octagonal shape, although the shape could also be circular. The inner wall 38 is lined with a sound absorbing or sound suppressing material 40 which is preferably a foam of egg-crate shape comprising a plurality of segments of a size and shape to confirm to the octagonal shape of inner wall 38.

Figure 3:
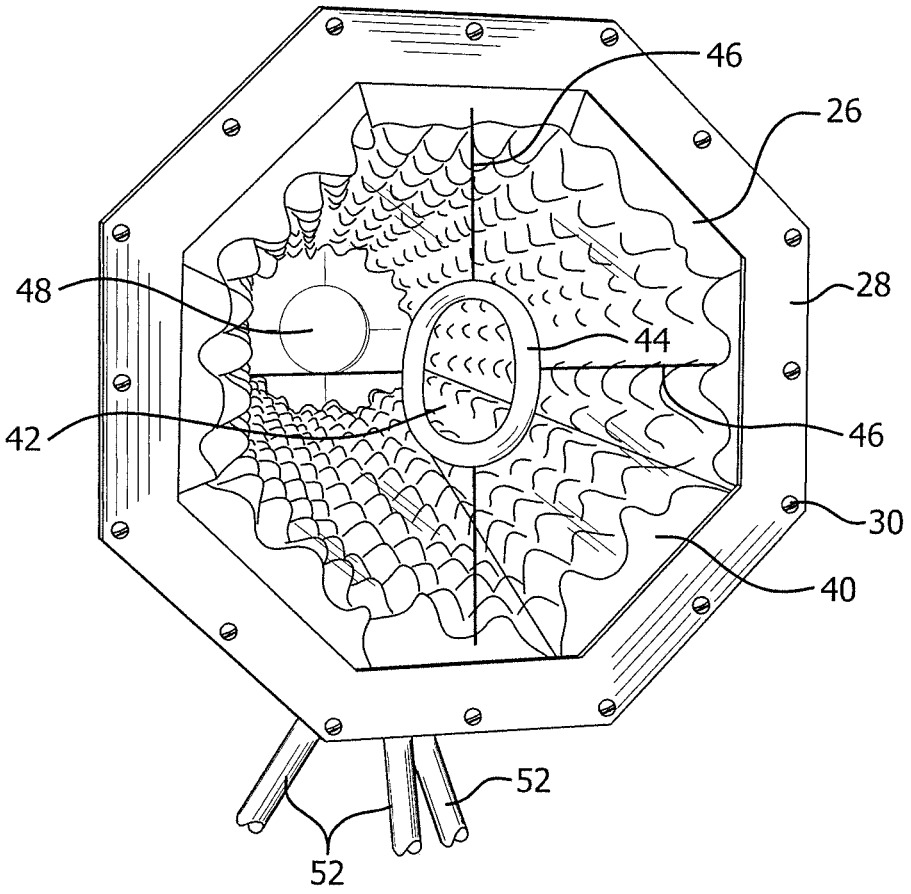
FIG. 3 is a front perspective view of the gun muffler of FIGS. 1-2.

As best shown in FIGS. 3 and 5 front wall 26 includes a centrally located entry hole 42 into which a gun barrel would be inserted. Opening 42 is reinforced by rim 44. Cross hairs 46 extend outwardly from entry hole 42. A continuation of the cross hairs would result in the cross hairs intersecting at the center of entry hole 42. Preferably, entry hole 42 is oval in shape and is larger than exit hole 48 located in back wall 36. The shot bullet would pass through exit hole 48. Preferably exit hole 48 is of circular shape. Entry hole 42, however, is preferably oval in shape thereby making hole 42 slightly oversized with respect to the size of a conventional gun barrel. The oval shape and oversized hole in front wall 26 permits barrel movement and the accommodation of different size gun barrels. Because the gun barrel would not be physically located in exit hole 48 it is not necessary to have a reinforcing rim at exit hole 48.

Figure 4:
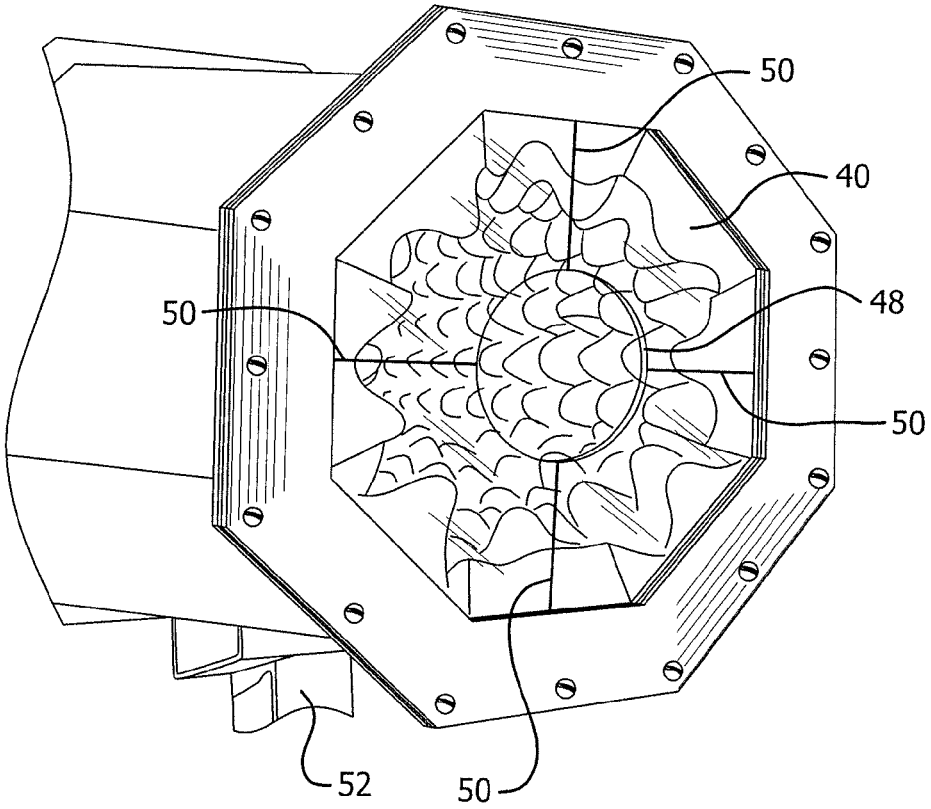
FIG. 4 is a rear perspective view of the gun muffler of FIGS. 1-3.

As best shown in FIGS. 4-5 exit hole 48 also includes cross hairs 50 which extend outwardly from exit hole 48. A continuation of the cross hairs 50 would result in their intersection at the center of exit hole 48.

Front wall 26 and back wall 36 are made of a non-opaque material and in particular the area of the cross hairs on each wall is non-opaque. Preferably the entire front wall 26 and back wall 36 is made of a Plexiglas® screen which is completely transparent. In use the shooter would align cross hairs 46 and cross hairs 50 with each other and with the target 14. The ability to align the cross hairs and target is accomplished because of the transparency or non-opaque nature of the front wall 26 and back wall 36. When the cross hairs and target are aligned with each other there is greater assurance of accurate shooting.

Figure 2:
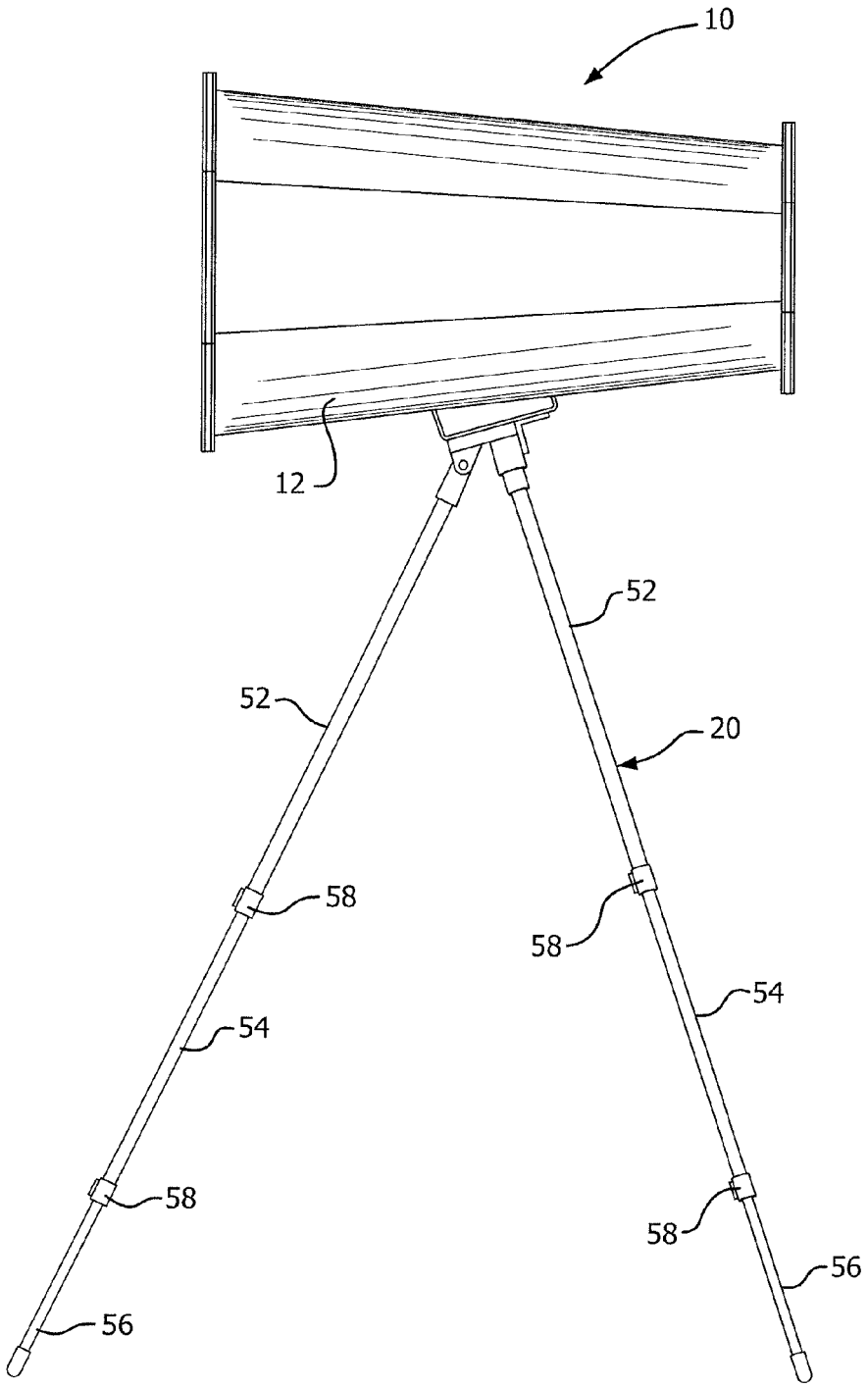
FIG. 2 is a side elevational view of the gun muffler of FIG. 1.

As shown in FIGS. 1-2 housing 12 is mounted on stand 20. Stand 20 is preferably adjustable so that the shooter is better able to angularly adjust housing 12. Preferably stand 20 is a tripod having three legs which are independently adjustable in length. Housing 12 is secured permanently or detachably in any suitable manner to the top of tripod stand 20. Each leg of stand 20 comprises a plurality of telescopic sections. For example, upper sections 52 telescopically receive intermediate sections 54 which receive lower sections 56. Locks 58 adjustably control the effective length of the combined sections 52,54,56. The adjustability of the tripod stand 20 facilitates aligning the housing 12 with target 14. Thus, as illustrated in FIG. 1 tripod stand 20 could be adjusted so that housing 12 is downwardly inclined to be in line with the lower level target 14. As also illustrated, the generally conically shaped housing 12 has the front end of housing 12 as its larger end.

An exemplary embodiment of muffler 10 would be to have housing 12 twenty-four inches long with the maximum width of front wall 26 being eighteen inches and the maximum width of back wall 36 being nine inches.

In use gun muffler 10 would be moved to a suitable location appropriately away from target 14. Stand 20 would be adjusted so that housing 12 is axially aligned toward target 14. The gun barrel would be inserted into entry hole 42 and the cross hairs 46 and 50 would be aligned with each other and with target 14. Gun 18 would then be shot and its sound would be muffled by sound absorbing foam 40.

What is claimed is:

1. A target shooting gun muffler comprising an elongated housing, said housing having a front wall and a back wall and an interior wall, said interior wall having a sound suppressing lining, an entry hole extending through said front wall, an exit hole extending through said back wall, entry hole cross hairs extending outwardly from said entry hole, the continuation of said entry hole cross hairs intersecting in said entry hole, exit hole cross hairs extending outwardly from said exit hole, the continuation of said exit hole cross hairs intersecting in said exit hole, and each of said front wall and said back wall in at least the area of said entry hole cross hairs and said exit hole cross hairs being made of a non-opaque material whereby a shooter may align said entry hole cross hairs and said entry hole cross hairs with each other and with a target to facilitate shooting accuracy.

2. The muffler of claim 1 wherein said entry hole is larger than said exit hole.

3. The muffler of claim 2 wherein said entry hole is oval shaped.

4. The muffler of claim 3 wherein said exit hole is of circular shape, and said entry hole having a reinforcing rim.

5. The muffler of claim 2 wherein said back wall is transparent.

6. The muffler of claim 5 wherein said front wall is transparent.

7. The muffler of claim 6 wherein said entry hole cross hairs intersect at the center of said entry hole, and said exit hole cross hairs intersecting at the center of said exit hole.

8. The muffler of claim 7 wherein said entry hole is located at the center of said front wall, and said exit hole being located at the center of said back wall.

9. The muffler of claim 6 wherein each of said front wall and said back wall comprises a screen mounted between a rim on said housing and a frame outwardly of said rim.

10. The muffler of claim 6 wherein said housing is mounted on a stand to elevate said housing.

11. The muffler of claim 10 wherein said stand is adjustable in height and angular orientation.

12. The muffler of claim 11 wherein said stand comprises a tripod having three legs each of which is independently adjustable in length.

13. The muffler of claim 6 wherein said housing is of generally conical shape.

14. The muffler of claim 13 wherein said generally conical shape is a tapered octagon.

15. The muffler of claim 14 wherein said sound suppressing lining comprises foam segments made of foam absorbing material, and each of said segments corresponding in size and shape to a corresponding wall of said octagon.

16. The muffler of claim 13 wherein said housing has its front end of larger size than its back end.

17. The muffler of claim 6 including a target mounted remote from and in line with said housing.

18. The muffler of claim 1 wherein said front wall and said back wall are made of transparent material.

19. The muffler of claim 1 wherein said housing is mounted on a stand having a plurality of legs each of which is independently adjustable in length to permit the angular adjustment of said housing.

* * * * *